United States Patent [19]

Austin

[11] 4,311,233

[45] Jan. 19, 1982

[54] EASEL DISPLAY PACKAGE

[75] Inventor: John J. Austin, Elkhart, Ind.

[73] Assignee: Champion International Corporation, Stamford, Conn.

[21] Appl. No.: 152,680

[22] Filed: May 23, 1980

[51] Int. Cl.[3] ..... B65D 25/24; B65D 5/52

[52] U.S. Cl. ..... 206/45.25; 206/44 R; 206/45.21

[58] Field of Search ..... 206/44 R, 45.19, 45.21, 206/45.25, 45.26, 45.27

[56] References Cited

U.S. PATENT DOCUMENTS

| | | | |
|---|---|---|---|
| 1,775,618 | 9/1930 | Kubler | 206/45.25 |
| 2,031,575 | 2/1936 | Roe | 206/45.21 |
| 2,138,460 | 11/1938 | Ringler | 206/45.25 |
| 2,159,887 | 5/1939 | Darragh | 206/45.25 |
| 2,517,030 | 8/1950 | Ringler | 206/45.21 X |
| 2,716,485 | 8/1955 | Hecker | 206/45.25 |

*Primary Examiner*—Steven M. Pollard
*Attorney, Agent, or Firm*—Evelyn M. Sommer

[57] ABSTRACT

An easel type display package suitable for containing and displaying a plurality of individually packaged products includes a rear wall, a pair of sidewalls, and a front wall which is substantially cut-away to reveal the product. The rear wall is inclined rearwardly to support the product within the package in an upwardly tilted position. Stabilizing structure for preventing the package from tipping over includes a support flap cut from the rear wall and a connecting flap hingedly connected to the support flap. The support flap is hingedly connected to the rear wall and extends downwardly and outwardly therefrom, while the connecting flap extends inwardly toward the rear wall and is provided with a locking tongue. A cover flap hingedly connected to the bottom wall extends upwardly in overlying relationship to the cut-out and includes a slit for receiving the locking tongue of the connecting flap therein. The lower surface of the connecting flap extends coplanar with the bottom wall and provides a support surface in back of the package for stabilizing the same.

12 Claims, 9 Drawing Figures

Fig. 1.
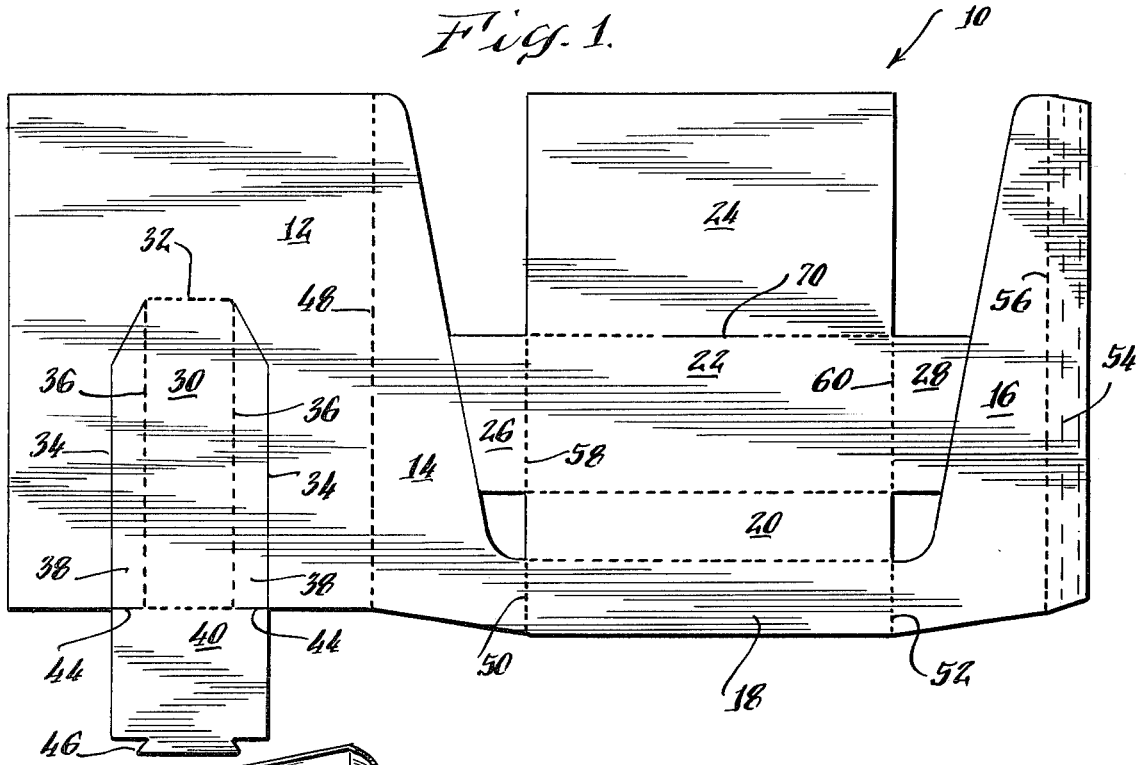
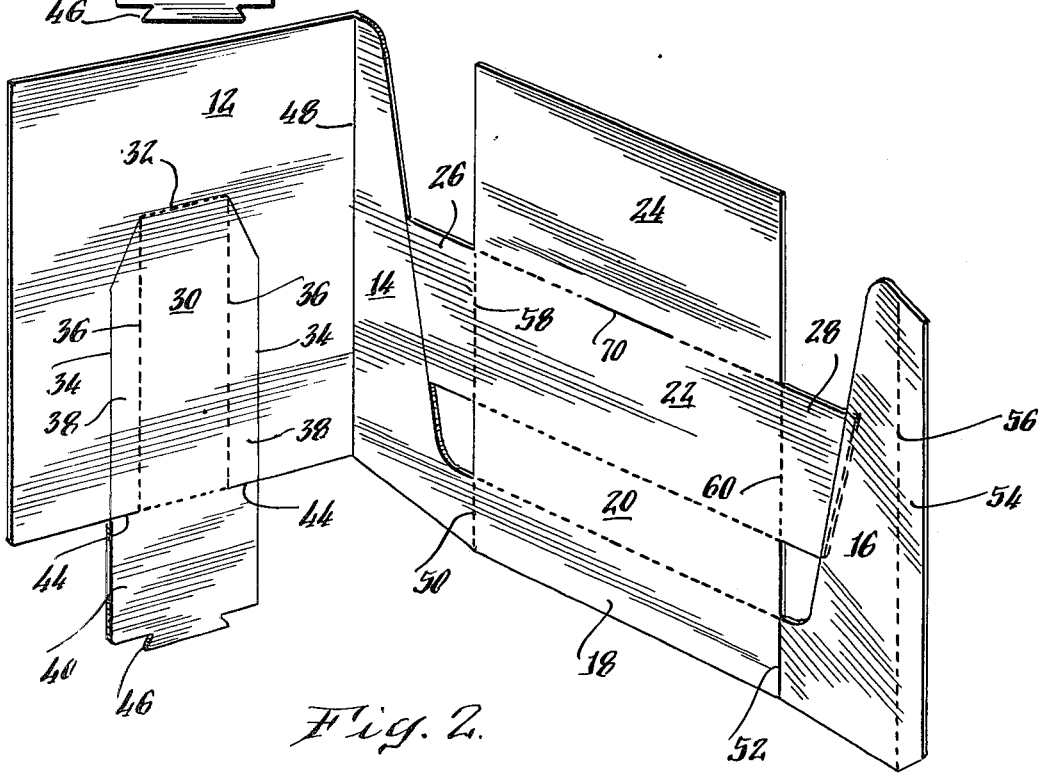
Fig. 2.

EASEL DISPLAY PACKAGE

TECHNICAL FIELD

The present invention generally relates to the packaging art, and deals more particularly with an easel type display package for supporting a plurality of packaged products on a support surface in an inclined attitude.

BACKGROUND AND BRIEF DESCRIPTION OF THE INVENTION

Numerous types of packaged products, such as soda straws packaged within rectangularly shaped cartons, are difficult to display in the market place in a manner which catches the consumer's attention, but yet which allows easy, individual dispensing thereof. In the past, individually packaged products were sometimes displayed in a rectangularly shaped display carton, for example, in which the front panel thereof was partially removed to expose the product therewithin. These types of prior art display packages employed vertical interior walls such that the individual product cartons extended essentially vertical from the surface on which the display package rested. In the case of display packages which were placed on relatively low level shelves or counter tops, it was difficult for the consumer to view and thereby identify the product being displayed.

In some cases, products of the type described above were dumped into large display bins in a randomly piled and scattered disposition in order to meet the requirements of adequate display to the consumer and ease of dispensing. This approach to the problem, however, was not only somewhat disorderly but consumed more floor space than was necessary.

Accordingly, it is a primary object of the present invention to provide a display package for containing a plurality of individually packaged products which is adapted to rest on a supporting surface and provides maximum visibility of the products while facilitating easy dispensing thereof.

A further object of the present invention is to provide a display package of the type described above in which the individual ones of the product cartons are disposed in a tilted or inclined attitude in order to enhance visibility thereof.

Another object of the invention related to the foregoing object, is to provide a display package of the type mentioned which is neither subject to tipping over nor allows the product to fall out thereof.

A still further object of the present invention is to provide a display package of the type described above which supports the product in an easel like fashion.

A further object of the present invention is to provide an easel type display package which may be shipped and stored in a compact position and which may be quickly erected for display use.

These and further objects of the invention will be made clear or will become apparent during the following description. In accordance with the present invention, an easel type display package includes a rear wall, a pair of sidewalls, a front wall, and a bottom wall joined together to form an enclosure. The front wall is substantially shorter than the rear wall and forward portions of the sidewalls are cut-away to provide a substantial access opening in the front and top of the package. The rear wall is inclined rearwardly to support individual product cartons within the package in an upwardly tilted disposition. The package is prevented from tipping over rearwardly by support structure connected to the rear wall, which includes a support flap cut from the rear wall and a connecting flap hingedly attached to the support flap. The support flap is hingedly connected to central areas of the rear wall and extends rearwardly and downwardly therefrom toward the surface upon which the package is to rest. The connecting flap contacts the surface upon which the package is to rest and extends forwardly toward the bottom of the rear wall. The free outer extremity of the connecting flap is provided with a tongue which is matingly received in a slit formed in a cover flap within the enclosure which is hingedly connected to the bottom wall and extends upwardly into overlapping relationship to the cut-out in the rear wall created therein when the package is erected. Reinforcement panels hingedly connected along the lateral edges of the support flap rigidify the supporting structure.

DESCRIPTION OF THE DRAWINGS

In the drawings, which form an integral part of the specification and are to be read in conjunction therewith, and in which like reference numerals are employed to designate like parts in the various views:

FIG. 1 is a plan view of a unitary blank of paperstock cut and configured to provide a blank for erecting the display package of the present invention;

FIGS. 2 through 5 are perspective views showing the successive steps in folding the blank of FIG. 1 to form the fully erected display package;

DETAIL DESCRIPTION OF THE INVENTION

Figure 3:
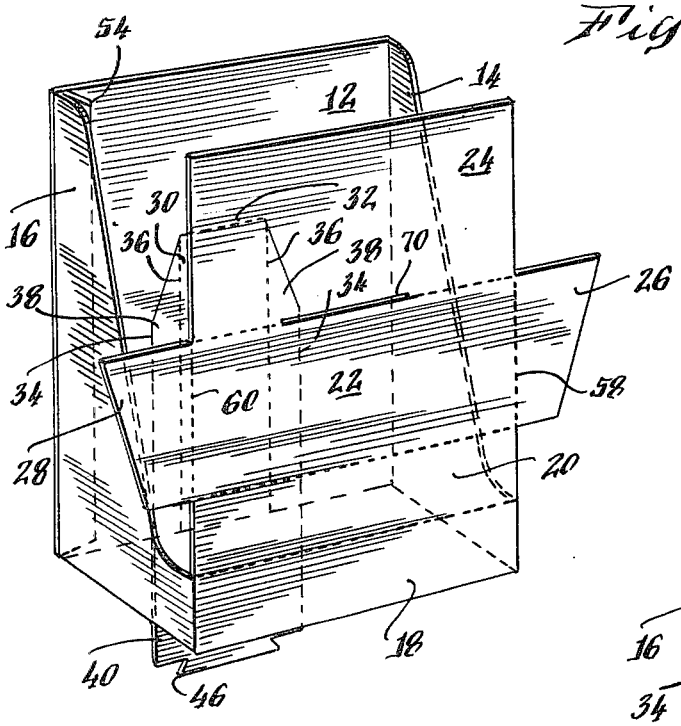

Referring first to FIG. 1, a blank generally indicated by the numeral 10 for forming the display package of the present invention, includes a rectangular rear wall 12, a pair of trapezoidal sidewalls 14 and 16 respectively, a front wall comprising rectangularly shaped panels 18 and 20, a rectangular bottom wall 22, a rectangular cover flap 24 and a pair of inner panels 26 and 28.

The blank 10 further includes a support flap 30 defined in rear wall 12 by fold line 32 and a pair of laterally spaced cut-lines 34 which extend perpendicularly upward from the lower edge of rear wall 12 and converge inwardly toward each other to the opposite extremities of fold line 32. The support flap 30 is further provided with a pair of spaced fold lines 36 which extend parallel to, and are spaced inwardly from, the cut-lines 34 to define a pair of trapezoidally shaped reinforcement panels 38. A rectangularly shaped connecting flap 40 has the upper edge thereof hingedly connected by a fold line 42 to the lower edge of support flap 30, while the outer extremities of the upper edge of connecting flap 40 are coextensive with the reinforcement panels 38 and are separated from the panels 38 by corresponding cut-lines 44. The edge of connecting flap 40 opposite edge 42 is provided with a generally rectangularly shaped locking tongue 46 which depends downwardly therefrom.

One edge of sidewall 14 is connected to the inner edge of rear wall 12 by fold line 48 while the opposite edge of sidewall 14 is hingedly connected by fold line 50 to one vertical edge of panel 18. The opposite edge of panel 18 is connected by fold line 52 to one edge of sidewall 16. A trapezoidally shaped glue flap 54 is connected by a vertically extending fold line 56 to the edge of sidewall 16 opposite the fold line 52. Fold lines 48, 50, 52 and 56 extend essentially parallel to each other.

Bottom wall 22 has the opposite vertical edges thereof connected by fold lines 58 and 60 to the respectively associated inner panels 26 and 28. One edge of inner panel 26 is separated from an adjacent edge of sidewall 14 by a cut-line 62 while one edge of inner panel 28 opposite fold line 60 is separated from the adjacent edge of sidewall 16 by a cut-line 64. The upper and lower, horizontally extending edges of bottom wall 22 are respectively connected by fold lines 66 and 68 to the lower edge of cover flap 24 and the upper edge of panel 20. Cover flap 24 is essentially rectangular in shape and a horizontal cut-line forming a locking slit 70 is provided in the central stretch of fold line 66.

Panels 18 and 20 are hingedly connected along mutual edges thereof by fold line 72 which extends parallel to fold lines 66 and 68.

Figure 4:
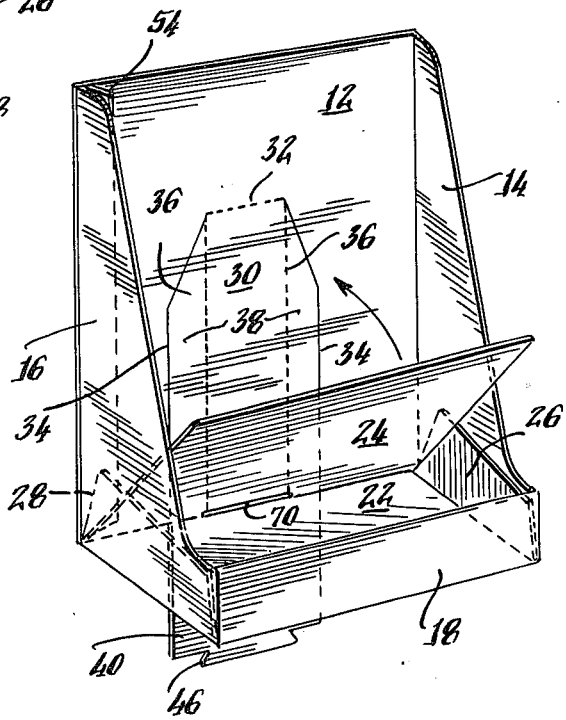
Figure 5:
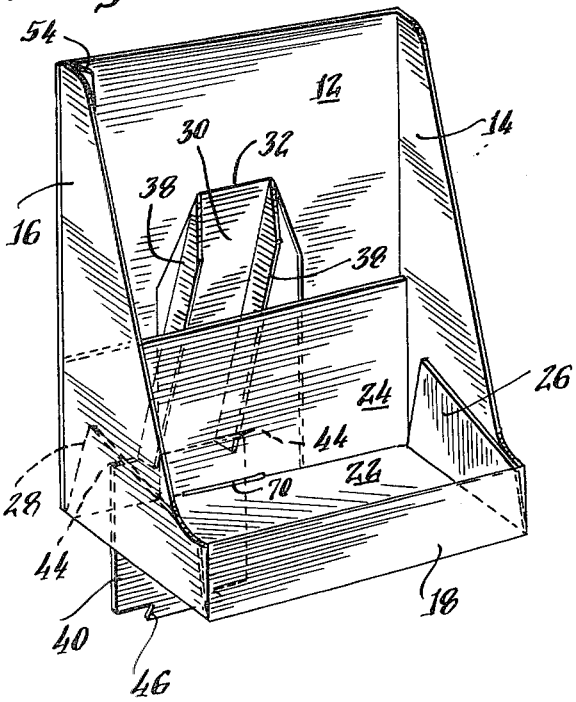
Figure 6:
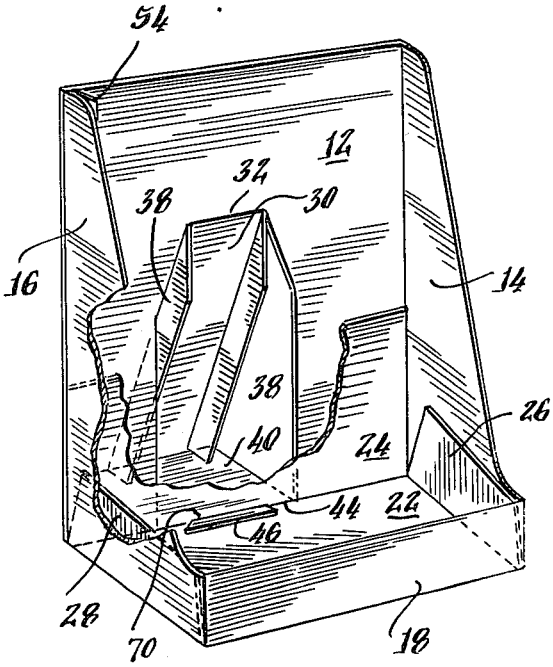
FIG. 6 is a perspective view of the display package of the present invention in its fully erected form, with the supporting structure opened to its operative, supporting position, parts being broken away in section for clarity.
Figure 7:
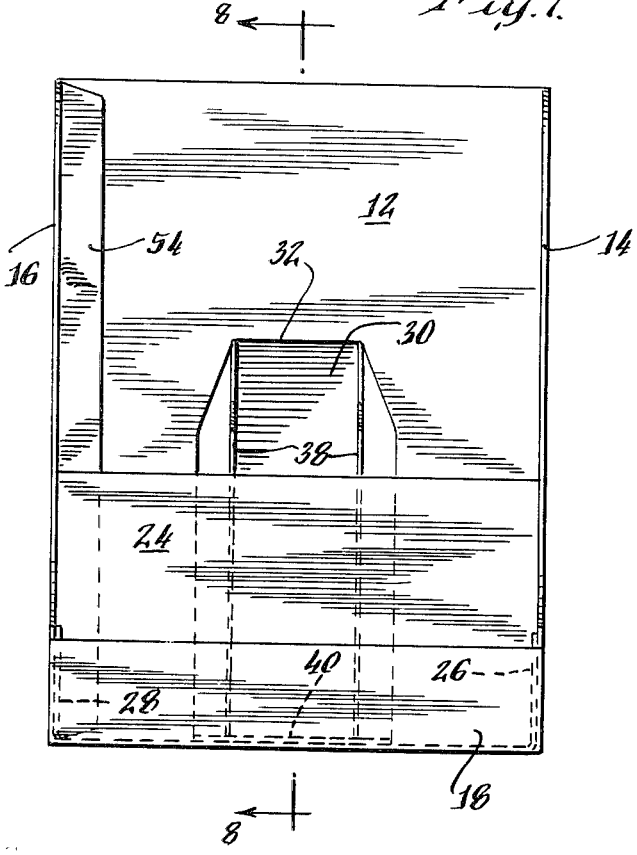
FIG. 7 is a front elevational view of the display package of FIG. 6.
Figure 8:
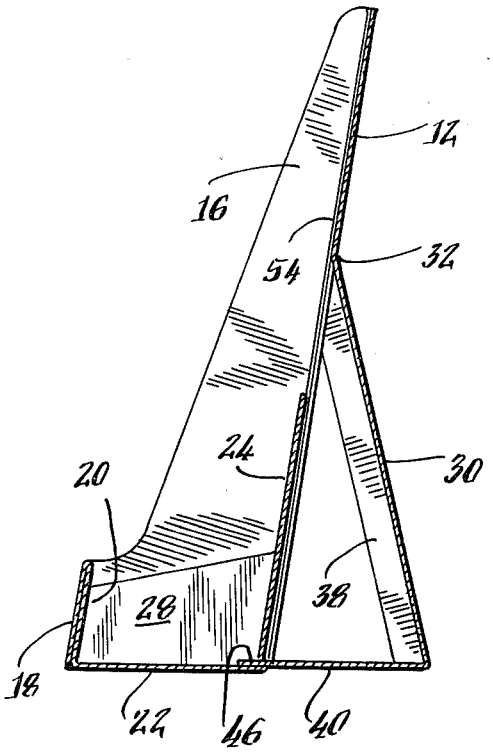
FIG. 8 is a sectional view taken along the line 8—8 in FIG. 7.
Figure 9:
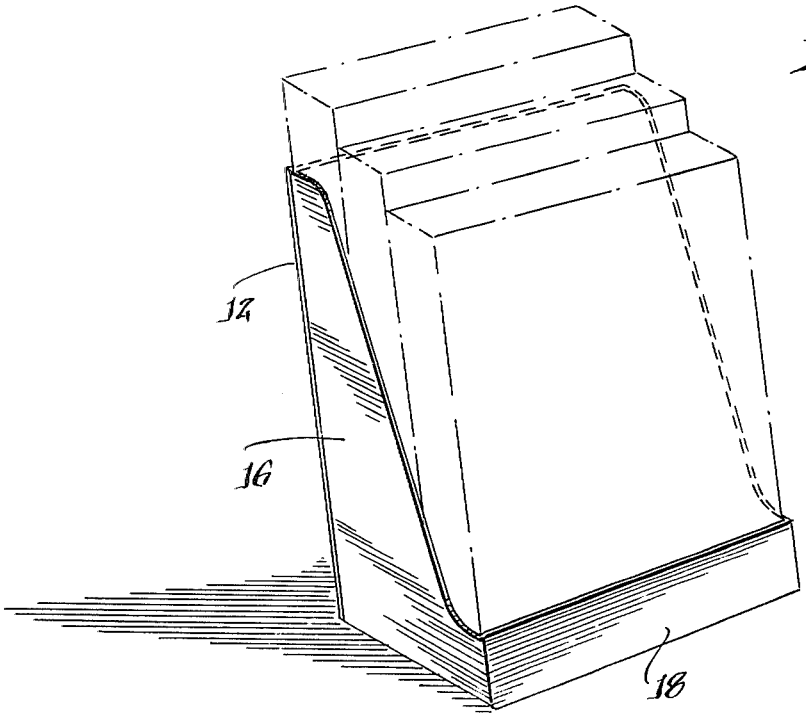
FIG. 9 is a perspective view of the display package of FIG. 6 shown filled with product cartons to be displayed.

Referring now to FIGS. 2 through 5, the first step in folding the blank 10 into an erected package consists of folding sidewall panel 14, front wall panel 18, sidewall 16 and glue flap 54 90° about the corresponding fold lines 48, 50, 52 and 56 such that the outside face of the glue flap 54 is disposed along the interior face of the outer edge of rear wall 12. At this point, glue flap 54 is secured as with adhesives to the rear wall 12 to form a tube-like enclosure. Next, front wall panel 20 is pivoted 180° inwardly about fold line 72 into face-to-face contact with the interior side of front wall panel 18. This last folding step results in the inner panels 26 and 28 engaging the corresponding edges of sidewalls 14 and 16, and further results in the cover flap 24 engaging the rear wall 12. As front wall panel 20 is pivoted, bottom wall 22 pivots 90° about fold line 68 relative to front wall panel 22 until bottom wall 22 is disposed at the bottom of the enclosure, in coplanar relationship with the lower edges of front wall panel 18, sidewalls 14 and 16, and rear wall 12. During the folding process described above, inner panels 26 and 28 as well as cover flap 24 pivot 90° about the corresponding fold lines 58, 60 and 66 and extend perpendicularly upward from the bottom wall 22.

At this point, connecting flap 40 may be pivoted about fold line 42 upwardly into underlapping relationship to the bottom wall 22 and the partially erected package may be filled with product. At this point, the full display package may be prepared for shipping or storage by enclosing the same in a wrapper or the like. This may be accomplished, for example, by sliding the filled package into a tubular enclosure (not shown). Also, if desired, a paperboard strap (not shown) attached to the rear wall 12 or sidewalls 14, 16 may be trained around the package and the product cartons therein in order to prevent movement of the product cartons within the package during shipping or storage.

The display package may be readied for display use by pivoting the support flap 30 rearwardly about fold line 32 until the tongue 46 of connecting flap 40 is in clearing relationship to the rear edge (fold line 66) of bottom wall 22. Tongue 46 is then inserted into the slit provided by cut 70 thereby locking the connecting flap 40 and support flap 30 in a stationary, supporting position behind the rear wall 12. Next, the reinforcement panels 38 are each pivoted approximately 90° forwardly about the associated fold lines 36; as reinforcement panels 38 are pivoted the lower edges thereof (adjacent cut lines 44 in FIG. 1) frictionally engage the upper surface of connecting flap 40 and thereby hold the reinforcement panels 38 in their folded, reinforcing positions, substantially perpendicular to the support flap 30.

With the display package in its fully erected, display position, connecting flap 40 extends essentially coplanar with bottom wall 22 behind rear wall 12 and forms an extension of the bottom wall 22 which provides an easel type support for this package. The reinforcement panels 38 substantially rigidify the support flap 30 about its longitudinal axis to prevent potential buckling thereof under the weight of the product impinging upon the rear wall 12. Rear wall 12 is inclined rearwardly in order to support the product cartons in a tilted attitude which improves display visibility. The front wall of the package comprising the hingedly connected abutting panels 18 and 20 is likewise inclined rearwardly and is substantially shorter in height than the rear wall 12. The relatively short height of the front wall maximizes the exposure of the product cartons and essentially functions as a stop for engaging the lower portions of the product cartons which prevents the same from sliding forwardly out of the package.

Inner panels 26 and 28 along with cover flap 24 form, in combination with panel 20 a rigidifying enclosure within the package for supporting and containing the lower parts of the product cartons.

From the foregoing, it can be appreciated that the easel type display package disclosed herein not only provides for the reliable accomplishment of the objects of the invention but does so in a particularly simply and economical manner It is recognized, of course, that those skilled in the art may make various modifications or additions to the preferred embodiment chosen to illustrate the invention without departing from the scope and spirit of the present contribution to the art. Accordingly, it is to be understood that the protection sought and to be afforded hereby should be deemed to extend to the subject matter claimed and all equivalents thereof fairly within the scope of the invention.

What is claimed is:

1. A package for displaying a product on a supporting surface, comprising:

a bottom wall adapted to lie on said surface;

a pair of sidewalls connected to said bottom wall and extending upwardly therefrom;

a rear wall extending upwardly from said bottom wall and connected to each of said sidewalls of said pair thereof;

said bottom, rear and pair of sidewalls forming an enclosure for containing said products therein; and support means for preventing said rear wall from being pivoted rearwardly onto said surface, said support means including a first portion comprising a support flap having one extremity thereof hingedly connected to said rear wall at a location thereon spaced above said bottom wall and extending rearwardly from said rear wall, said support means including a second portion comprising a connecting flap having one extremity thereof hingedly connected to the other extremity of said support flap and extending inwardly from said first portion toward said rear wall wherein said rear wall includes a cut-out section therein between said bottom wall and said location thereon, said package further includes a cover flap hingedly connected to said bottom wall and extending upwardly therefrom in overlapping relationship to said cut-out section, and the other extremity of said connecting flap is releasably secured to said cover flap.

2. The package of claim 1, wherein:

said other extremity of said connecting flap includes a locking tongue thereon, and said cover flap includes a locking slit therein adjacent said bottom wall, said tongue being inserted into said slit for securing said connecting flap to said cover flap.

3. A blank comprising a unitary sheet of paperstock for forming the package of claim 2.

4. The package of claim 1, wherein there is further provided:

a pair of reinforcement panels respectively hingedly connected to opposite lateral edges of said support flap and each extending angularly away from the plane of said support flap toward said rear wall.

5. The package of claim 4, wherein one end of each of said reinforcing panels engages the upper surface of said connecting flap.

6. The package of claim 1, wherein each of said connecting flap and said support flap is essentially rectangular in shape.

7. The package of claim 1, wherein said bottom wall includes a rear edge and said rear wall extends rearwardly from said rear edge of said bottom wall, such that said rear wall is inclined with respect to said bottom wall, said package further including a front wall spaced forwardly from said rear wall, said front wall extending between said pair of sidewalls and connected to each of the latter.

8. The package of claim 7 wherein the upper end of said front wall is horizontally spaced below said location on said rear wall.

9. The package of claim 7, wherein each of said sidewalls of said pair thereof is essentially trapezoidal in shape.

10. The package of claim 7, wherein said front wall comprises a pair of panels disposed in face-to-face relationship to each other and joined to each other by a fold line.

11. The package of claim 1, including a pair of inner panels respectively associated with said pair of sidewalls, said inner panels being respectively hingedly connected along opposite lateral edges of said bottom walls and extending upwardly therefrom.

12. A blank comprising a unitary sheet of paperstock for forming the package of claim 1.

* * * * *